US011162201B2

(12) United States Patent
Ahamad et al.

(10) Patent No.: US 11,162,201 B2
(45) Date of Patent: Nov. 2, 2021

(54) LID ASSEMBLY FOR A LAUNDRY APPLIANCE

(71) Applicant: WHIRLPOOL CORPORATION, Benton Harbor, MI (US)

(72) Inventors: Iftkhar Ahamad, Pune (IN); Neyda Eleza Leon Lopez, Monterrey (MX); Raghavendran Prabhakaran, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 199 days.

(21) Appl. No.: 16/384,210

(22) Filed: Apr. 15, 2019

(65) Prior Publication Data

US 2020/0325609 A1 Oct. 15, 2020

(51) Int. Cl.
*D06F 1/10* (2006.01)
*D06F 37/28* (2006.01)
*D06F 37/18* (2006.01)

(52) U.S. Cl.
CPC ..... *D06F 1/10* (2013.01); *D06F 37/18* (2013.01); *D06F 37/28* (2013.01)

(58) Field of Classification Search
CPC ..... D06F 37/18; D06F 37/28; D06F 1/10
USPC ..... 68/3 R
See application file for complete search history.

(56) References Cited

U.S. PATENT DOCUMENTS

| | | | | |
|---|---|---|---|---|
| 8,176,757 | B2 | 5/2012 | Yoo et al. | |
| 8,297,085 | B2 | 10/2012 | Kim et al. | |
| 8,511,115 | B2 | 8/2013 | Kim et al. | |
| 8,627,692 | B2 | 1/2014 | Tooker | |
| 9,777,420 | B2 | 10/2017 | Nash et al. | |
| 9,909,248 | B2 | 3/2018 | Mora et al. | |
| 2009/0229320 | A1* | 9/2009 | Yoo | D06F 23/04 68/3 R |

FOREIGN PATENT DOCUMENTS

| | | | | |
|---|---|---|---|---|
| EP | 3181750 | A1 * | 6/2017 | D06F 39/14 |

* cited by examiner

*Primary Examiner* — Tinsae B Ayalew
(74) *Attorney, Agent, or Firm* — Price Heneveld LLP

(57) ABSTRACT

A laundry appliance includes a cabinet defining an interior cavity. A frame has a raised outer edge and defines a support structure. A first panel is received by the outer edge of the frame and rests upon the support structure in a first lid configuration. A second panel is received by the outer edge of the frame and rests upon a portion of the support structure in a second lid configuration. A trim is selectively coupled to the support structure in the second lid configuration.

15 Claims, 7 Drawing Sheets

LID ASSEMBLY FOR A LAUNDRY APPLIANCE

FIELD OF THE DISCLOSURE

The present disclosure generally relates to a lid assembly for a laundry appliance, and more specifically, to a lid assembly having a first lid configuration and a second lid configuration.

BACKGROUND OF THE DISCLOSURE

Conventional laundry appliances may include a wide range of models and variations that require separate support frames for attaching different lids to the laundry appliance. Additionally, conventional laundry appliances may also require separate support frames for lids that include trim panels and lids that do not.

SUMMARY OF THE DISCLOSURE

According to one aspect of the present disclosure, a laundry appliance includes a cabinet defining an interior cavity. A frame has a raised outer edge and defines a support structure. A first panel is received by the outer edge of the frame and rests upon the support structure in a first lid configuration. A second panel is received by the outer edge of the frame and rests upon a portion of the support structure in a second lid configuration. A trim is selectively coupled to the support structure in the second lid configuration.

According to another aspect of the present disclosure, a lid assembly for a laundry appliance includes a first panel and a second panel. A frame has a raised outer edge for receiving the first panel in a first lid configuration and the second panel in a second lid configuration. The frame defines snap feature apertures and bosses concealed by the first panel in the first lid configuration. A trim is coupled to the frame in the second lid configuration. The trim includes protrusions defining openings and snap elements extending from a bottom surface of the trim.

According to yet another aspect of the present disclosure, a lid assembly for a laundry appliance includes a frame having support structures. Each of the support structures include a horizontal surface and a vertical surface defining snap feature apertures. A first panel is coupled to the frame in a first lid configuration, wherein the horizontal surfaces of the support structures support the first panel. A second panel is coupled to the frame in a second lid configuration. A trim includes snap elements extending from a bottom surface of the trim, wherein the elements cooperate with the snap feature apertures to couple the trim to the frame in the second lid configuration.

These and other features, advantages, and objects of the present disclosure will be further understood and appreciated by those skilled in the art by reference to the following specification, claims, and appended drawings.

Figure 1:
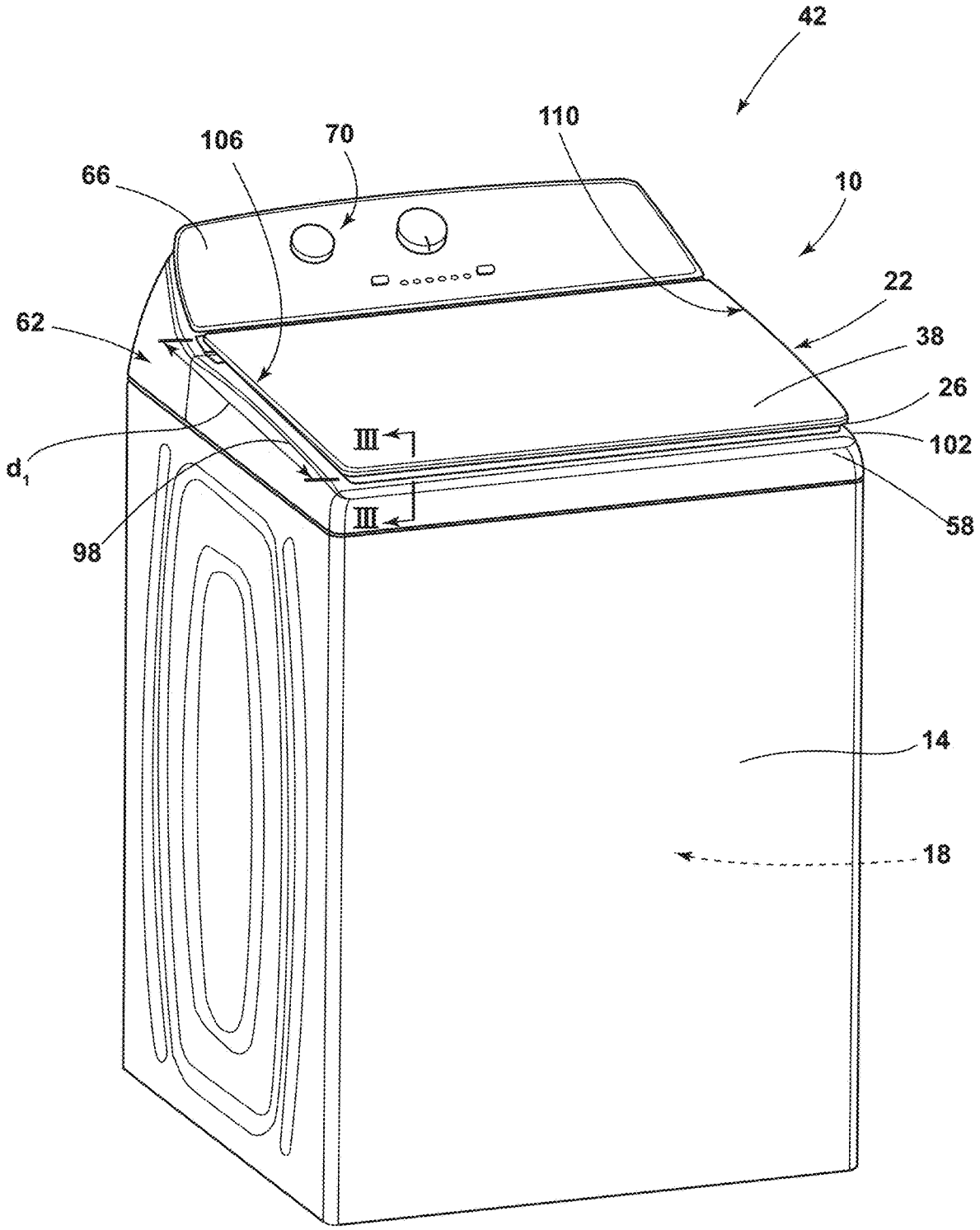
FIG. 1 is a side perspective view of a laundry appliance having a lid assembly in a first lid configuration, according to one example.

The components in the figures are not necessarily to scale, emphasis instead being placed upon illustrating the principles described herein.

DETAILED DESCRIPTION

The present illustrated embodiments reside primarily in combinations of method steps and apparatus components related to a lid assembly for a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-10, reference numeral 10 generally refers to a laundry appliance including a cabinet 14 defining an interior cavity 18. The laundry appliance 10 includes a lid assembly 22 with a frame 26 having a raised outer edge 30, wherein the frame 26 defines a support structure 34. A first panel 38 is received by the outer edge 30 of the frame 26 and rests upon the support structure 34 in a first lid configuration 42 (exemplified in FIGS. 1-3). A second panel 46 is received by the outer edge 30 of the frame 26 and rests upon a portion of the support structure 34 in a second lid configuration 50. A trim 54 is selectively coupled to the support structure 34 of the frame 26 in the second lid configuration 50 (exemplified in FIGS. 5-10).

Referring to FIG. 1, the laundry appliance 10 includes the cabinet 14 with a top panel 58 positioned on the cabinet 14. The top panel 58 defines a raised rear portion 62 for supporting a fascia 66 having a control 70. The control 70 is illustrated as having buttons and dials, however, it is contemplated that the control 70 may include any feature for controlling the operation of the laundry appliance 10. The fascia 66 may be positioned on an angle relative to the cabinet 14 to provide easier access to the controls 70 for a user. It is also contemplated that the fascia 66 and/or controls 70 may be positioned elsewhere on the laundry appliance 10. The laundry appliance 10 is depicted as a top load vertical axis washer, however, the laundry appliance may also be a horizontal axis washer or other front-load washer, a dryer, or a combination washer and dryer.

Figure 2:
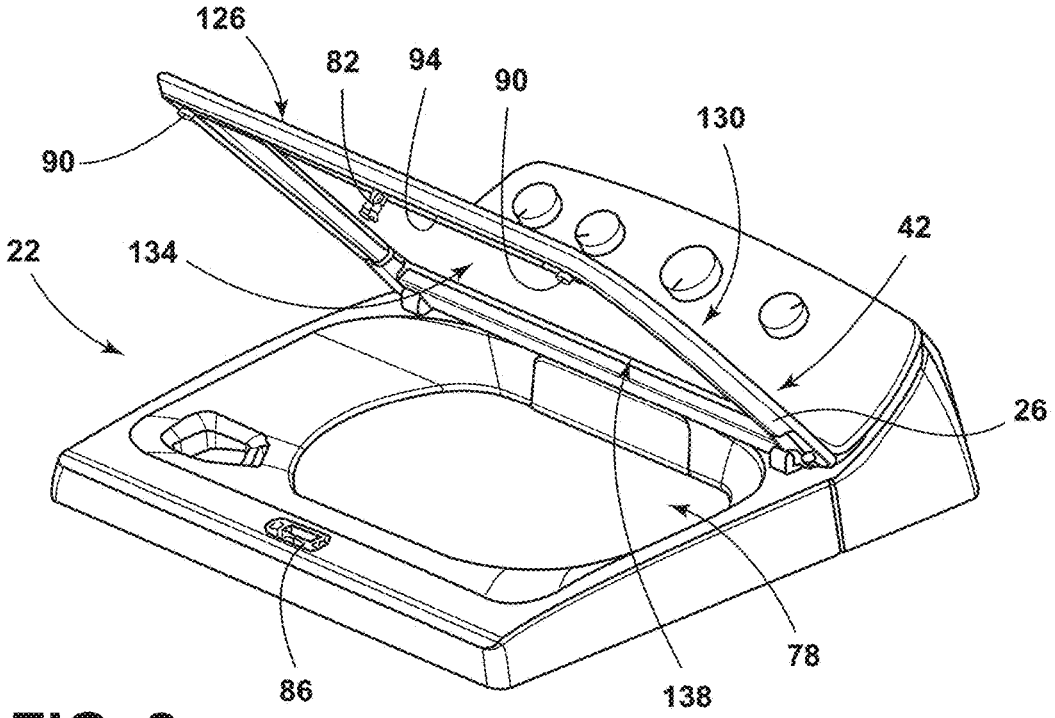
FIG. 2 is a side perspective view of the lid assembly in the first lid configuration, according to one example.

Referring to FIGS. 1 and 2, the lid assembly 10 of the laundry appliance 10 is operable between a lowered position and a raised position. In the lowered position, the lid assembly 22 encloses the interior cavity 18 of the cabinet 14. In the raised position, the lid assembly 22 provides access to the interior cavity 18 via an opening 78 defined by the top panel 58. The lid assembly 22 may be coupled to the top panel 58 and/or the cabinet 14 via a hinge member or other pivoting coupling feature. The lid assembly 22 may include a striker 82 that couples to a latch 86 positioned on the top panel 58. The striker 82 and latch 86 operate to lock the lid assembly 22 into the lowered position. Additionally or alternatively, the lid assembly 22 may include bumpers 90 coupled to a lower surface 94 of the frame 26. The bumpers 90 may support the lid assembly 22 as it rests upon the top panel 58 in the lowered position. The bumpers 90 may also be advantageous for protecting components of the laundry appliance 10 in the event of harder contact between the top panel 58 and the lid assembly 22.

As illustrated, the lid assembly 22 may extend from a first lateral edge 98 of the laundry appliance 10 to a second opposing lateral edge 102. In other words, first and second side edges 106, 110 of the lid assembly 22 may substantially align with the first and second lateral edges 98, 102 of the top panel 58 and/or the cabinet 14 of the laundry appliance 10. It is also contemplated that the laundry appliance 10 may include shoulders extending along the first and second lateral edges 98, 102 of the top panel 58, and the lid assembly 22 may extend between the shoulders. In other words, the lid assembly 22 may extend an entire width or a portion of the width of the laundry appliance 10.

Figure 3:
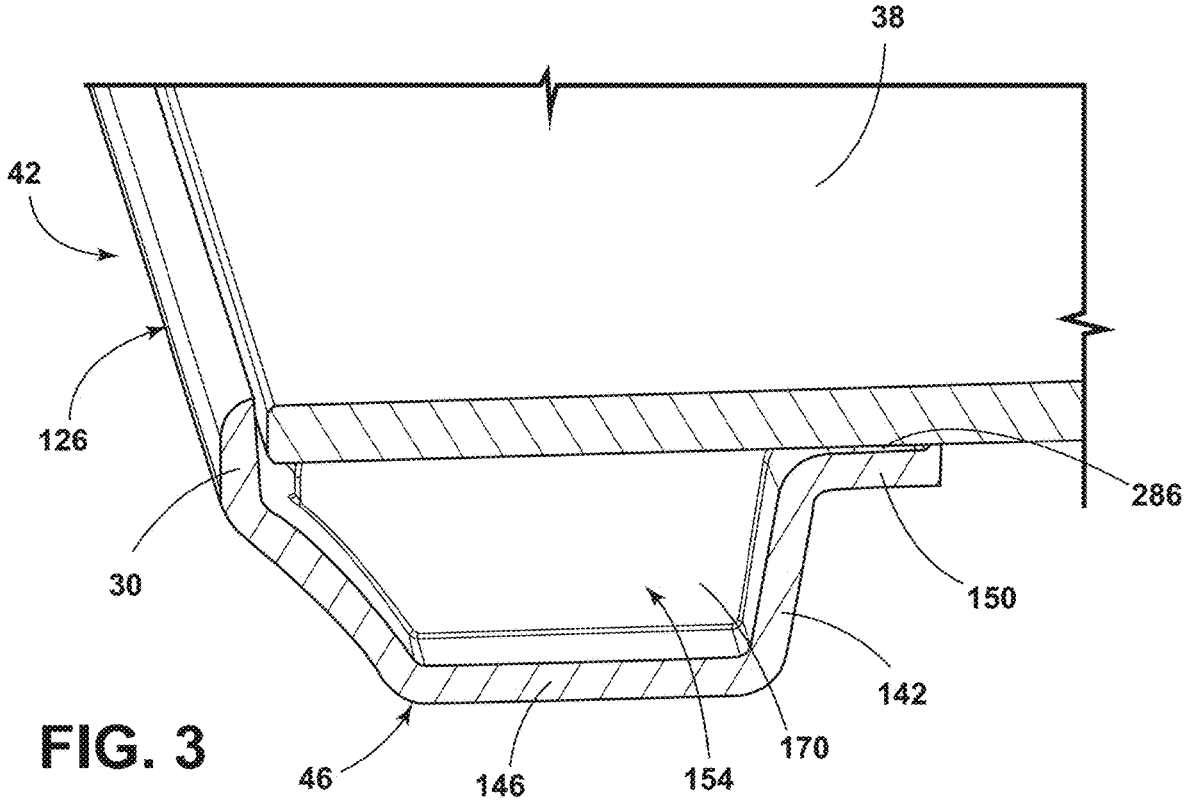
FIG. 3 is a cross-sectional view taken along line III-III of FIG. 1 of a frame and a first panel in the first lid configuration, according to one example.

Referring to FIGS. 2 and 3, in the first lid configuration 42, the first panel 38 is positioned on the frame 26. The frame 26 includes the raised outer edge 30 extending along the perimeter of the frame 26. The outer edge 30 receives the first panel 38 in the first lid configuration 42. In various examples, the first panel 38 abuts the outer edge 30 on a front portion 126 of the frame 26. In such examples, the first panel 38 extends over the frame 26, such that the first panel 38 abuts the outer edge 30 of the frame 26 along the entire perimeter of the frame 26. In some examples, the frame 26 may extend under the entire first panel 38. In other examples, the frame 26 may couple to edge portions 130 of the first panel 38, but not couple to a central portion 134 of the first panel 38. In such examples, the frame 26 may define a cutout 138. The cutout 138 may be advantageous for allowing a user to view the interior cavity 18 (FIG. 1) when the lid assembly 22 is in the lowered position.

Referring to FIG. 3, the first panel 38 is shown abutting the outer edge 30 on the front portion 126 of the frame 26. The outer edge 30 may extend vertically upwards from a bottom 146 of the frame 26 and extend at an angle in a range of from about 30° to about 90°. The outer edge 30 of the frame 26 may extend above the first panel 38. In various examples, the frame 26 may also include a raised inner edge 142. The inner edge 142 may extend vertically upwards from the bottom 146 of the frame 26, and may include a platform 150. As illustrated, the inner edge 142 has a height less than a height of the outer edge 30. Accordingly, the first panel 38 may abut the outer edge 30 and rest upon the platform 150 of the inner edge 142. When positioned on the frame 26, the first panel 38 and the frame 26 cooperate to define an enclosure 154, or a plurality of enclosures 154.

Figure 4:
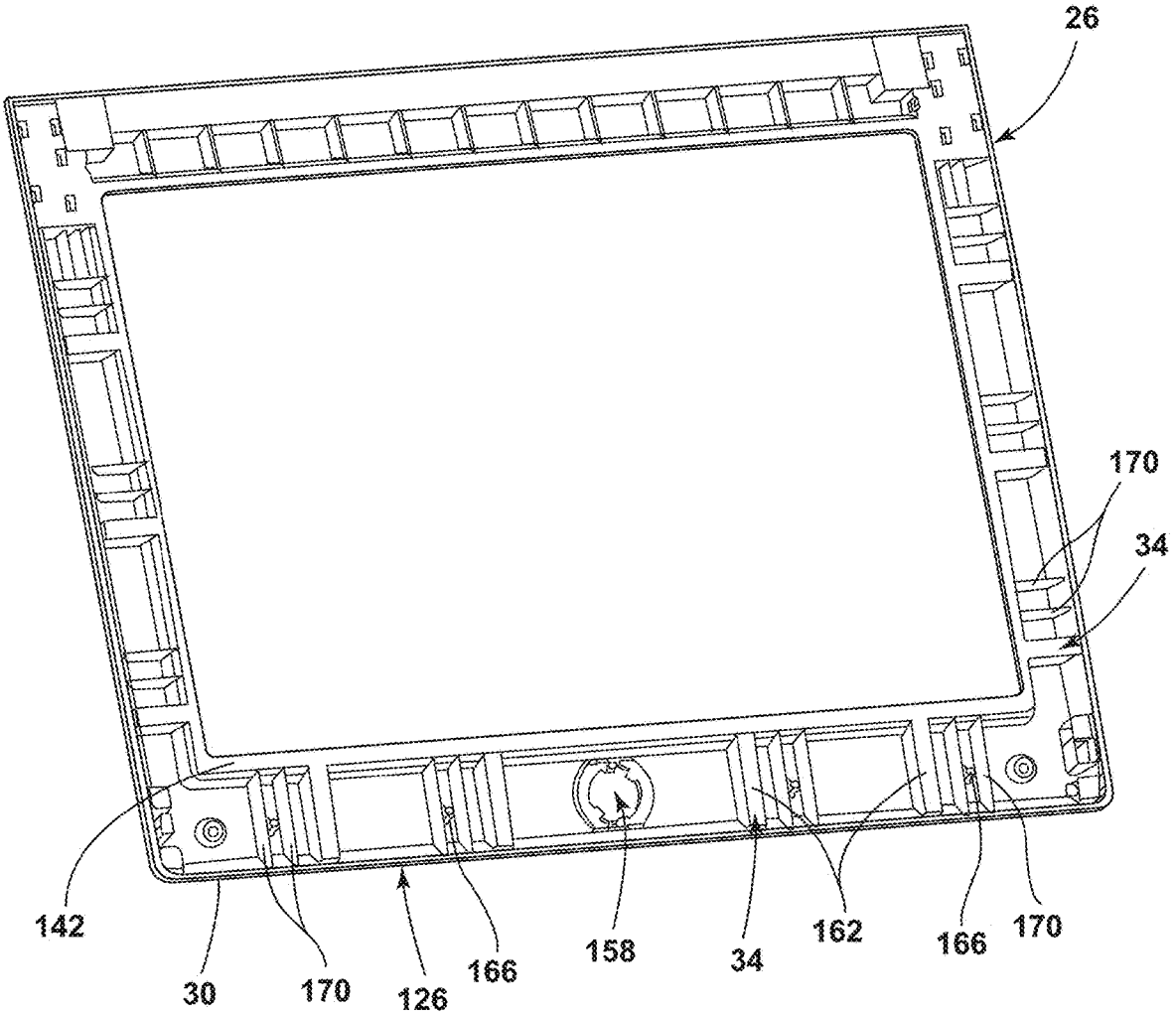
FIG. 4 is a top perspective view of the frame of the lid assembly, according to one example.

Referring now to FIGS. 2 and 4, the front portion 126 of the frame 26 defines a hole 158 for the striker 82 to extend through. Further, the frame 26 defines support structures 34 extending upward from the bottom 146 of the frame 26. The support structures 34, as illustrated, extend between the outer and inner edges 30, 142 of the frame 26. The support structures 34 may be spaced at intervals around the frame 26. In some examples, the support structures 34 may be spaced apart at substantially equidistant intervals, and in other examples, the support structures 34 may be spaced apart at irregular intervals. The support structures 34 may be advantageous in managing abuse loads acting on the lid assembly 22. Accordingly, the support structures 34 may be positioned around all or a portion of the frame 26. The support structures 34 may also divide the space between the first panel 38 and the frame 26 into a plurality of enclosures 154.

Referring to FIGS. 3 and 4, in various examples, the support structures 34 may extend a substantially similar height as the inner edge 142 of the frame 26. In such examples, the first panel 38 may rest upon horizontal surfaces 162 of the support structures 34. The frame 26 may also include bosses 166 extending from the bottom 146 of the frame 26. In various examples, the bosses 166 are evenly spaced across the front portion 126 of the frame 26. As illustrated in FIG. 4, the frame 26 includes four bosses 166. However, it is contemplated that more or fewer bosses 166 may be included on the frame 26. The frame 26 may also include ridges 170 extending vertically upwards from the bottom 146 of the frame 26. The ridges 170 may be positioned around all or a portion of the frame 26. The ridges 170 may be positioned substantially parallel to the support structures 34. As such, the ridges 170 may extend between the outer and inner edges 30, 142 of the frame 26. The ridges 170 may also be positioned adjacent to the bosses 166. The ridges 170 may be advantageous to increase the strength and/or rigidity of the frame 26, as well as provide additional support for abuse loads acting on the lid assembly 22. The ridges 170, as with the support structures 34, can define the plurality of enclosures 154. Cooperatively, the first panel 38, the bottom 146, the ridges 170, and the support structures 34 of the frame 26 define shear cavities that structurally support the lid assembly 22.

In the first lid configuration 42, the first panel 38 may be received by the outer edge 30 of the frame 26 and rest upon the support structure 34. In other words, the horizontal surfaces 162 of the support structures 34 may support the first panel 38. Additionally, the first panel 38 may conceal the ridges 170, bosses 166, and/or support structures 34 in the first lid configuration 42. The first panel 38 may be positioned over the ridges 170, bosses 166, and/or support structures 34 to abut the outer edge 30 of the frame 26. In various examples, the first panel 38 may include glass. Further, in glass examples, the first panel 38 may include tinted glass or colored glass. Additionally or alternatively, the glass may include a coating applied to all or part of the first panel 38 to conceal the frame 26. In further examples, the first panel 38 may include two-way glass, such that when the interior cavity 18 (FIG. 1) is illuminated by a light source the glass is substantially transparent, but when the interior cavity 18 is dark (e.g., not illuminated) the glass is substantially opaque.

Referring now to FIGS. 5-10, the laundry appliance 10 may include the lid assembly 22 in the second lid configuration 50. In the second lid configuration 50, the trim 54 is coupled to the frame 26 between a front edge 174 of the second panel 46 and the outer edge 30 of the front portion 126 of the frame 26. In other words, the trim 54 is positioned between the second panel 46 and the outer edge 30 of the frame 26. The lid assembly 22 operates in a substantially similar manner in the second lid configuration 50 as in the first lid configuration 42 (FIG. 1).

Figure 5:
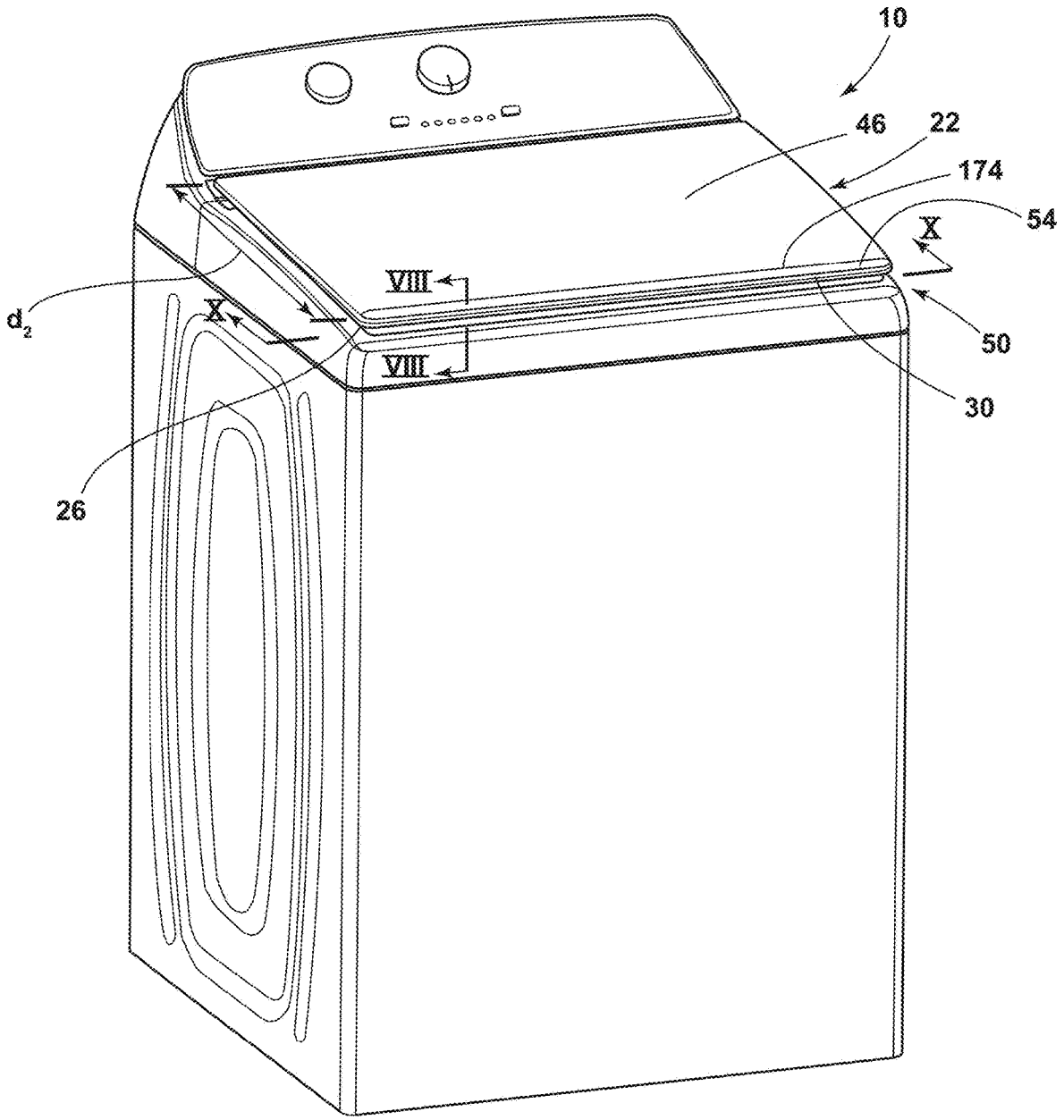
FIG. 5 is a side perspective view of the laundry appliance having the lid assembly in a second lid configuration, according to one example.

Referring to FIGS. 1 and 5, the frame 26 is typically the same style of frame 26 in both the first and second lid configurations 42, 50. In other words, the frame 26 can be designed and manufactured to receive the first panel 38 in the first lid configuration 42, and the second panel 46 in the second lid configuration 50. It may be advantageous to utilize the same frame 26 in both the first and second lid configurations 42, 50 to reduce production and manufacturing costs. It may be further advantageous to use the same frame 26 to prevent the need for additional tools to couple the trim 54 to the frame 26. The first panel 38 may extend to the outer edge 30 of the front portion 126 of the frame 26. In comparison, the second panel 46 may not extend to the outer edge 30 of the front portion 126 of the frame 26, but may extend to an interior edge 178 of the trim 54. The trim 54 may then extend between the second panel 46 and the outer edge 30 of the frame 26. Accordingly, the first panel 38 may have a first panel depth $d_1$ that is greater than a second panel depth $d_2$ of the second panel 46. However, the first and second panels 38, 46 may have substantially similar thicknesses and widths to be positioned properly within the frame 26.

Figure 6:
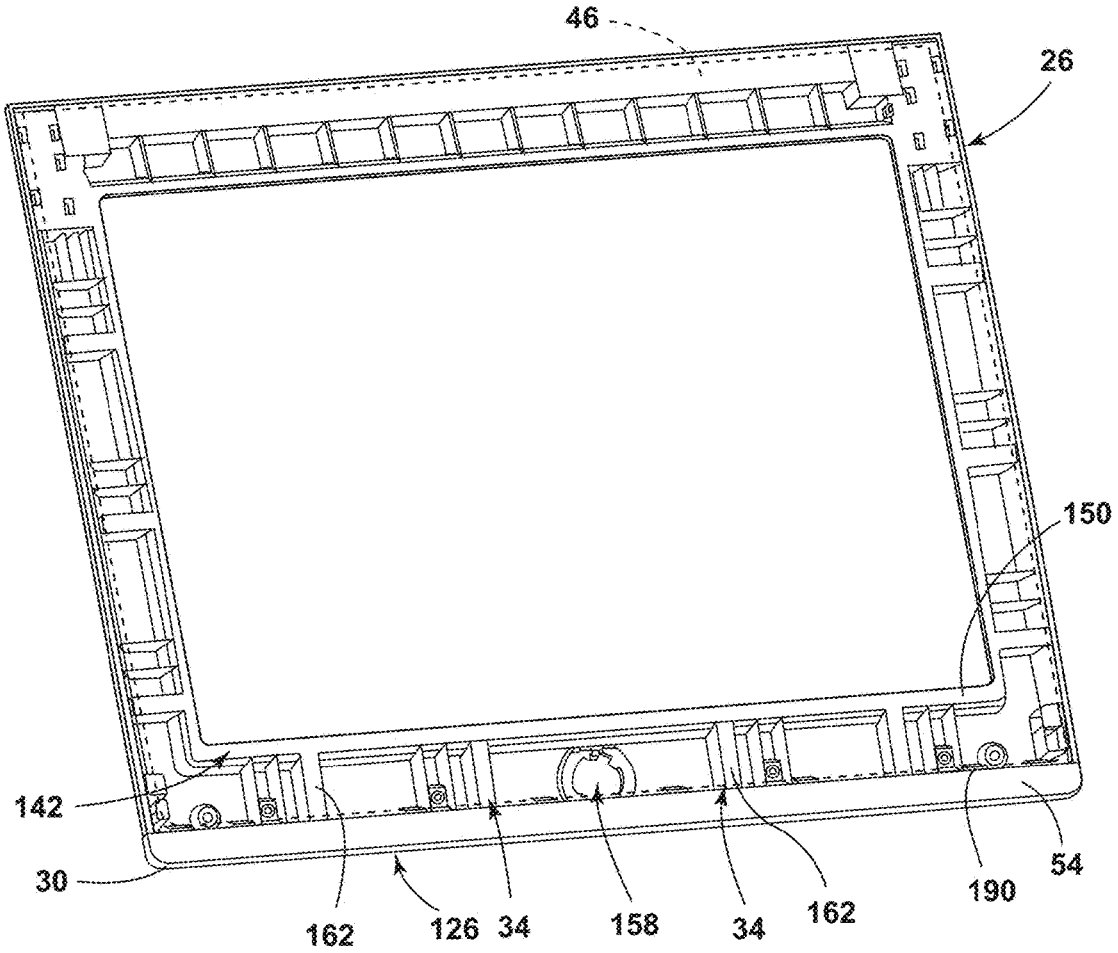
FIG. 6 is a top perspective view of the frame and a trim of the lid assembly, according to one example.
Figure 7:
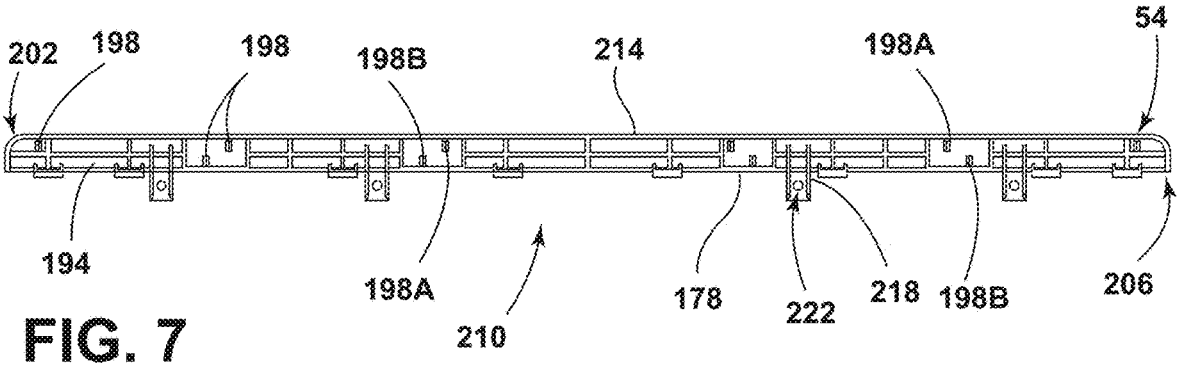
FIG. 7 is a bottom view of the trim having snap elements and protrusions, according to one example.
Figure 8:
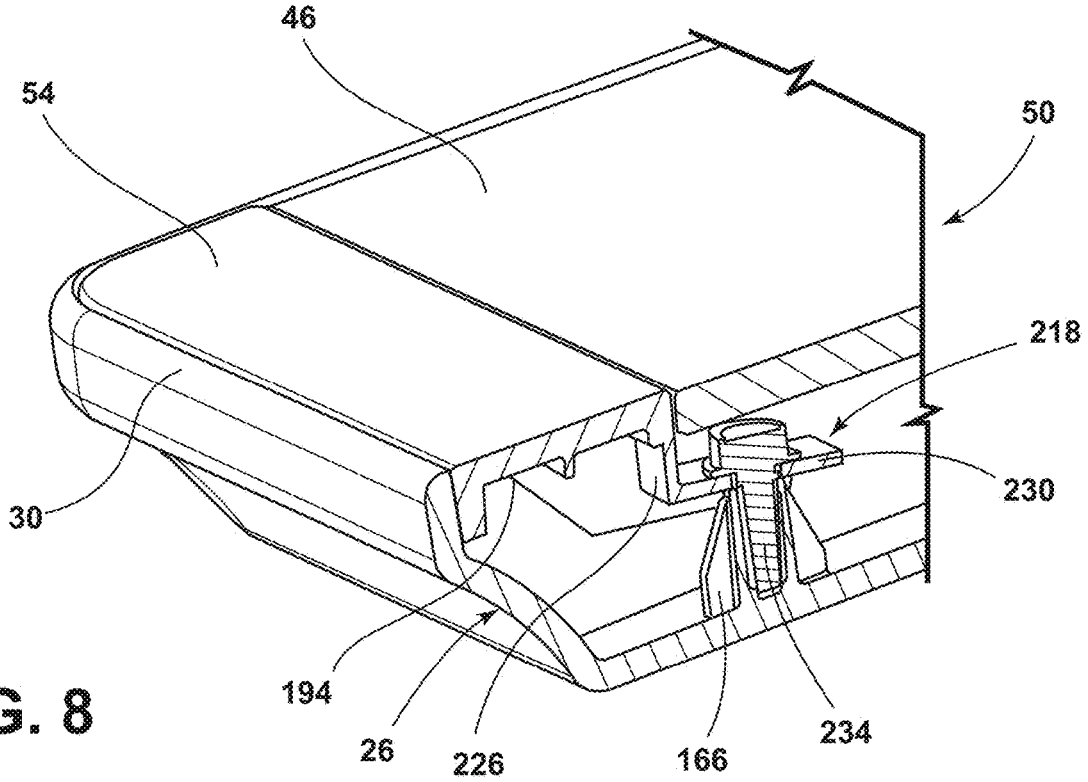
FIG. 8 is a cross-sectional view taken along line XIII-XIII of FIG. 5 of the frame, the trim, and a second panel in the second lid configuration, according to one example.

Referring now to FIGS. 6-8, the frame 26 and the trim 54 are illustrated with the second panel 46. The trim 54 is coupled to the front portion 126 of the frame 26. The trim 54 may extend a portion of the distance between the outer edge 30 and the inner edge 142 of the frame 26. As such, the hole 158 for the striker 82 (FIG. 2) may remain uncovered when the trim 54 is attached to the frame 26. However, in other examples, the trim 54 may extend a greater portion of the distance between the outer edge 30 and the inner edge 142, so as to partially or wholly cover the hole 158. The second panel 46 may rest upon the platform 150 of the inner edge 142 of the frame 26. The second panel 46 may also rest upon a portion of the support structures 34 of the frame 26. In such examples, the trim 54 may rest on a portion of horizontal surfaces 162 of the support structures 34 on the front portion 126 of the frame 26, and the second panel 46 may rest upon the remaining portion of the horizontal surfaces 162, which may define a portion of the platform 150. The horizontal surfaces 162 may be integrally formed with the platform 150. The trim 54 may also include tabs 190 spaced at regular or irregular intervals. The tabs 190 may assist in positioning and/or securing the trim 54 to the frame 26 and/or the second panel 46.

Referring to FIGS. 7-10, the trim 54 may include a plurality of snap elements 198 extending from a bottom surface 194 of the trim 54. As illustrated, the trim 54 includes ten snap elements 198, however, it is contemplated that the trim 54 may include fewer or more snap elements 198. The snap elements 198 may be positioned individually or in pairs of snap elements 198. For example, as illustrated, the trim 54 includes individual snap elements 198 positioned proximate to left and right end portions 202, 206 of the trim 54. On the other hand, a center portion 210 of the trim 54, includes pairs of snap elements 198. The pairs of snap elements 198 may each include a first snap element 198A and a second snap element 198B. The first snap element 198A may be offset from the second snap element 198B. In various examples, the first and second snap elements 198A, 198B of each pair of snap elements 198 may be horizontally offset, such that the first snap element 198A is positioned proximate to an exterior edge 214 of the trim 54 and the second snap element 198B is positioned proximate to the interior edge 178. Each of the pairs of snap elements 198 may include the same snap element configuration or different configurations. For example, each of the pairs of snap elements 198 may include the first snap element 198A as the left-most snap element of the pair that is proximate to the exterior edge 214. In other examples, as shown in FIG. 7, the pairs positioned on the left portion 202 of the trim 54 may include the first snap element 198A positioned proximate to the interior edge 178 and the pairs positioned on the right end portion 206 of the trim 54 may include the first snap element 198A positioned proximate to the exterior edge 214 of the trim 54 (e.g., a mirror image). The individual snap elements 198 may be positioned to horizontally align with the snap elements 198 in the pairs positioned proximate to the exterior edge 214 of the trim 54. The snap elements 198 may be spaced across the trim 54 at equal intervals, irregular intervals, or combinations thereof.

Referring to FIGS. 7 and 8, the trim 54 includes protrusions 218 defining openings 222. The protrusions 218 may be spaced apart along the trim 54, and may be spaced apart by equal intervals, irregular intervals, or a combination thereof, depending upon the design of the frame 26. As illustrated, the trim 54 includes four protrusions 218, but may include fewer or more protrusions 218. The protrusions 218 can operate to selectively couple the trim 54 to the frame 26 in the second lid configuration 50. The protrusions 218 may be substantially L-shaped, each having a vertical portion 226 and a horizontal portion 230. The horizontal portion 230 of each of the protrusions 218 may define the openings 222. In various examples, the protrusions 218 are configured to align with the bosses 166 defined by the frame 26. More specifically, the openings 222 of the protrusions 218 may be configured to align with the bosses 166 for receiving a fastener 234. In other words, the frame 26 defines bosses 166 for receiving the fastener 234 for selectively coupling the trim 54 to the frame 26. The fasteners 234 may be, for example, screws, bolts, pins, or other similar mechanical fasteners.

In various examples, the vertical portion 226 of the protrusions 218 extends downwards, such that the horizontal portion 230 of the protrusions 218 may extend under the second panel 46. As such, the protrusions 218 may not interfere with the placement of the second panel 46. Additionally, the bosses 166 may be spaced vertically apart from the second panel 46 and/or the bottom surface 194 of the trim 54 so as to not interfere with the placement of the second panel 46. The L-shape of the protrusions 218 may be advantageous for selectively coupling the trim 54 to the frame 26 without interfering with the placement of the second panel 46 on the frame 26 in the second lid configuration 50. Similarly, the L-shape of the protrusions 218 may allow the bosses 166 to have a smaller height, which may prevent the bosses 166 from interfering with the position of the second panel 46 and/or the position of the first panel 38 in the first lid configuration 42 (FIG. 1).

Referring still to FIG. 8, in various examples, the trim 54 may be flush with the second panel 46. The trim 54 may also be flush with the outer edge 30 of the frame 26. Alternatively, the trim 54 may extend above the outer edge 30 and/or the second panel 46. The trim 54 may also extend above the second panel 46 but not the outer edge 30, or extend above the outer edge 30 and not the second panel 46. The trim 54 may also be adjustable, such that a height of the trim 54 may be adjusted relative to the outer edge 30 of the frame 26 and/or the second panel 46.

Figure 9:
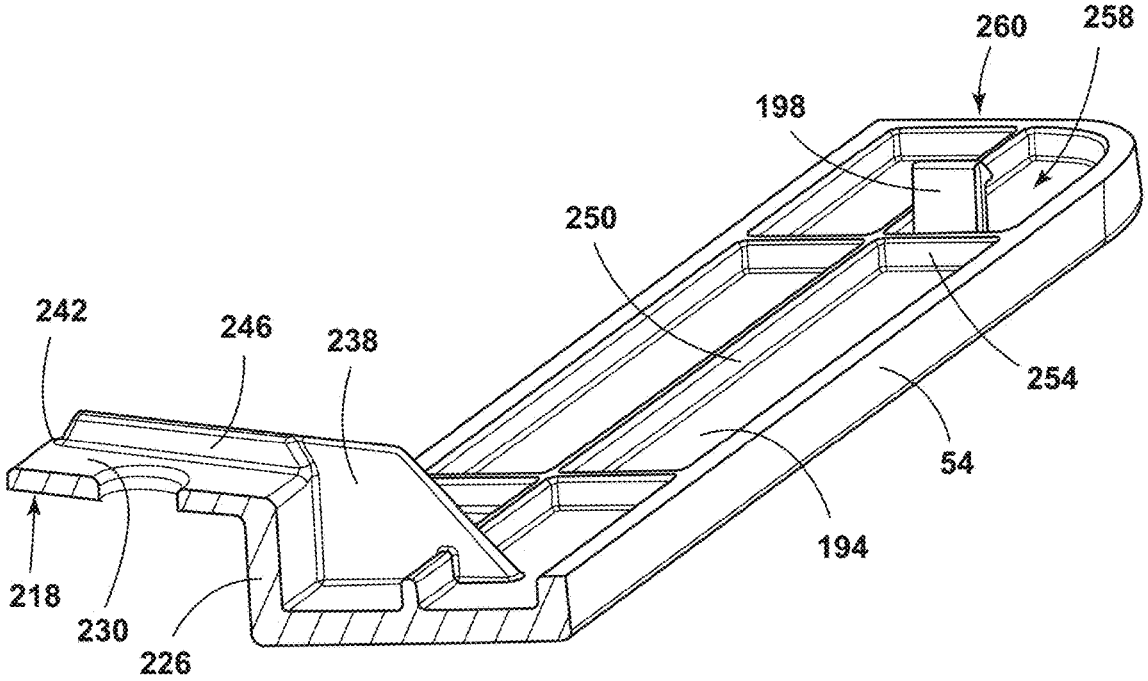
FIG. 9 is the cross-sectional view of a bottom surface of FIG. 8, removed from the lid and rotated, according to one example.

Referring to FIG. 9, the trim 54 may include angled supports 238 coupled to the vertical portion 226 of some or all of the protrusions 218. The angled supports 238 may be coupled to lateral ends 242 of horizontal portions 230 of the protrusions 218, respectively, such that there are two angled supports 238 per protrusion 218. The angled supports 238 may provide additional strength to the protrusions 218. Further, the angled supports 238 may align and/or correspond with projections 246 extending from the lateral ends 242 of the projections 246. Similar to the angled supports 238, the projections 246 may provide additional strength to the protrusions 218. The angled supports 238 and the projections 246 may also be advantageous to provide support to the trim 54 for managing typical loads as well as abuse loads acting on the lid assembly 22 (FIG. 1).

Additionally or alternatively, in various examples, the bottom surface 194 of the trim 54 may include ribs 250 and cross-ribs 254 that provide supplemental strength and support to the trim 54 and the lid assembly 22. The addition of ribs 250 and/or cross-ribs 254 may provide additional support to the trim 54 for managing typical loads and abuse loads. The ribs 250 may extend longitudinally across the bottom surface 194 of the trim 54. Each of the ribs 250 may extend the same length, varying length, or a combination thereof outward from the bottom surface 194. The cross-ribs 254 may extend laterally across the bottom surface 194. Each of the cross-ribs 254 may extend the same length, varying length, or a combination thereof outward from the bottom surface 194. The ribs 250 and cross-ribs 254 may extend the same length from the bottom surface 194 or a different length. In various examples, the orientation and size of the ribs 250 and cross-ribs 254 may depend on the projected typical and abuse loads that may operate on the lid assembly 22. The ribs 250 and cross-ribs 254 may create a uniform or irregular pattern across the bottom surface 194 of the trim 54. The ribs 250 and cross-ribs 254 may also be positioned along a perimeter edge 260 of the trim 54. The ribs 250 and cross-ribs 254 may also cooperate to define recesses 258. In such examples, the snap elements 198 may be positioned within the recesses 258.

Figure 10:
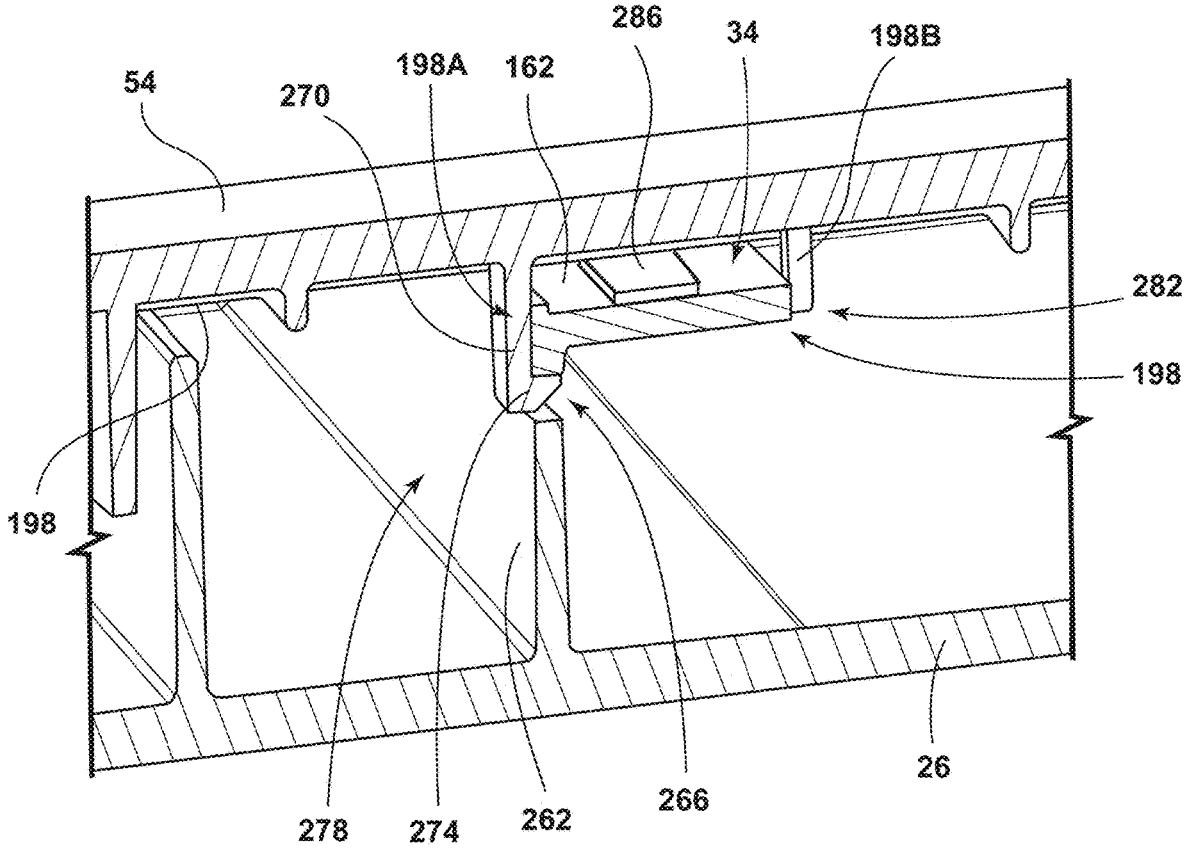
FIG. 10 is a cross-sectional view taken along a portion of line X-X of FIG. 5 of the snap feature apertures of the trim, according to one example.

Referring now to FIG. 10, the support structures 34 may be substantially L-shaped, having the horizontal surface 162 and a vertical surface 262. The vertical surfaces 262 of each of the support structures 34 may define a snap feature aperture 266. The snap elements 198 of the trim 54 may operate to selectively couple the trim 54 to the frame 26 via the snap feature apertures 266. In other words, the snap elements 198 are configured to align with the snap feature apertures 266. Each of the snap elements 198 include an elongated portion 270 and a hook portion 274. The hook portions 274 may be configured to extend into the snap feature apertures 266 of the support structures 34.

In various examples, the pairs of snap elements 198 may be oriented in different directions. For example, the hook portion 274 of the first snap element 198A may be oriented in a first direction and the hook portion 274 of the second snap element 198B may be oriented in a second opposing direction. In some examples, the hook portions 274 may be oriented inwards to face each other. Accordingly, the first snap element 198A may couple to a first side 278 of the support structure 34 and the second snap element 198B may couple to a second opposing side 282 of the support structure 34. This configuration provides greater bilateral strength in the engagement between the trim 54 and the frame 26. In such examples, the hook portion 274 of the second snap element 198B may couple to the horizontal surface 162 of the L-shaped support structure 34 and the first snap element 198A may align with the snap feature aperture 266 of the vertical surface 262. It is contemplated that the support structure 34 may include two vertical surfaces 262 defining snap feature apertures 266, such that both the first and second snap elements 198A, 198B may align with snap feature apertures 266. Additionally or alternatively, the snap elements 198 may extend different lengths from the bottom surface 194 of the trim 54. As illustrated, the first snap element 198A of the pair of snap elements 198 extends a greater length than the second snap element 198B. The differing lengths may be advantageous for coupling the first snap element 198A to the vertical surface 262 of the support structure 34, and coupling the second snap element 198B to the horizontal surface 162.

Referring to FIGS. 1-10, the lid assembly 22 may include a pad 286, such as an adhesive, may be coupled to the first panel 38, the second panel 46, and/or the trim 54 to the frame 26. The pad 286 may also be applied to the outer edge 30 and/or the inner edge 142 of the frame 26. The pad 286 may be applied continuously over the frame 26 or selectively applied to discrete portions of the frame 26. It is also contemplated that the first panel 38, second panel 46, and/or the trim 54 may be coupled to the frame 26 using different coupling methods.

In various examples, the first and second panels 38, 46 may include glass. As explained previously in relation to the first panel 38, the first panel 38 and the second panel 46 may include tinted glass or colored glass. Additionally or alternatively, the glass may include a coating applied to all or part of the first and second panels 38, 46 to conceal the frame 26. In further examples, the first and second panels 38, 46 may include two-way glass, such that when the interior cavity 18 is illuminated by a light source the glass is substantially transparent, but when the interior cavity 18 is dark (e.g., not illuminated) the glass is substantially opaque.

Use of the present disclosure may provide a variety of advantages. In a first example, the frame 26 may be configured to receive the first panel 38 in the first lid configuration 42, and the second panel 46 and the trim 54 in the second lid configuration 50. The frame 26 may be used on laundry appliances 10 including the first lid configuration 42, and also laundry appliances 10 including the second lid configuration 50. Additionally, the same laundry appliance 10 may switch between the first and second lid configurations 42, 50. In a second example, use of the presently disclosed lid assembly 22 may reduce manufacturing time as the tools utilized for adding the trim 54 to the laundry appliance 10 may be minimized and/or eliminated. In a third example, the lid assembly 22 as presently disclosed may reduce manufacturing and production costs as fewer or no additional tools may be required to add the trim 54 to the frame 26.

According to at least one aspect, a laundry appliance includes a cabinet defining an interior cavity. A frame has a raised outer edge and defines a support structure. A first panel is received by the outer edge of the frame and rests upon the support structure in a first lid configuration. A second panel is received by the outer edge of the frame and rests upon a portion of the support structure in a second lid configuration. A trim is selectively coupled to the support structure in the second lid configuration.

According to another aspect, the support structure is L-shaped and includes a horizontal surface and a vertical surface defining snap feature apertures.

According to another aspect, the support structure is concealed by the first panel in the first lid configuration.

According to still another aspect, the trim includes snap feature elements to selectively couple the trim to the frame via snap feature apertures.

According to another aspect, the snap elements extend different lengths outward from the trim.

According to another aspect, the trim includes protrusions defining openings for selectively coupling the trim to the frame in the second lid configuration.

According to yet another aspect, the trim is positioned between a front edge of the second panel and the outer edge of the frame in the second lid configuration.

According to at least one aspect, a lid assembly for a laundry appliance includes a first panel and a second panel. A frame has a raised outer edge for receiving the first panel in a first lid configuration and the second panel in a second lid configuration. The frame defines snap feature apertures and bosses concealed by the first panel in the first lid configuration. A trim is coupled to the frame in the second lid configuration. The trim includes protrusions defining openings and snap elements extending from a bottom surface of the trim.

According to another aspect, the second panel has a second panel depth less than a first panel depth of the first panel.

According to still another aspect, the protrusions are configured to align with the bosses defined by the frame.

According to another aspect, the snap elements are positioned in pairs in a center portion of the trim and configured to align with the snap feature apertures.

According to yet another aspect, a first snap feature of the pair is offset from a second snap feature of the pair.

According to another aspect, the frame defines a support structure, and each of the first snap features couple to a first side of the support structure and the second snap features couple to a second opposing side of the support structure.

According to another aspect, the frame defines ridges positioned adjacent to the bosses.

According to another aspect, the trim is positioned between the second panel and an outer edge of the frame in the second lid configuration.

According to at least one aspect, a lid assembly for a laundry appliance includes a frame having support structures. Each of the support structures include a horizontal surface and a vertical surface defining snap feature apertures. A first panel is coupled to the frame in a first lid configuration, wherein the horizontal surfaces of the support structures support the first panel. A second panel is coupled to the frame in a second lid configuration. A trim includes snap elements extending from a bottom surface of the trim, wherein the elements cooperate with the snap feature apertures to couple the trim to the frame in the second lid configuration.

According to another aspect, the first and second panels each comprise glass.

According to still another aspect, the first panel conceals the support structures in the first lid configuration.

According to another aspect, the second panel rests upon a portion of the horizontal surface of the support structure in the second lid configuration.

According to another aspect, the frame defines bosses for receiving a fastener for selectively coupling the trim to the frame.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A lid assembly for a laundry appliance, comprising:

a first panel;

a second panel, wherein the second panel has a second panel depth less than a first panel depth of the first panel;

a frame having a raised outer edge for receiving the first panel in a first lid configuration and the second panel in a second lid configuration, wherein the frame defines snap feature apertures and bosses concealed by the first panel in the first lid configuration; and a trim coupled to the frame in the second lid configuration, the trim comprising:

protrusions defining openings; and snap elements extending from a bottom surface of the trim.

2. The lid assembly for a laundry appliance of claim 1, wherein the protrusions are configured to align with the bosses defined by the frame.

3. The lid assembly for a laundry appliance of claim 1, wherein the snap elements are positioned in pairs in a center portion of the trim and configured to align with the snap feature apertures.

4. The lid assembly for a laundry appliance of claim 3, wherein a first snap feature of the pair is offset from a second snap feature of the pair.

5. The lid assembly for a laundry appliance of claim 4, wherein the frame defines a support structure, and wherein each of the first snap features couple to a first side of the support structure and the second snap features couple to a second opposing side of the support structure.

6. The lid assembly for a laundry appliance of claim 1, wherein the frame defines ridges positioned adjacent to the bosses.

7. The lid assembly for a laundry appliance of claim 1, wherein the trim is positioned between the second panel and the outer edge of the frame in the second lid configuration.

8. A lid assembly for a laundry appliance, comprising:

a first panel;

a second panel;

a frame having a raised outer edge for receiving the first panel in a first lid configuration and the second panel in a second lid configuration, wherein the frame defines snap feature apertures and bosses concealed by the first panel in the first lid configuration; and a trim coupled to the frame in the second lid configuration, the trim comprising:

protrusions defining openings; and snap elements extending from a bottom surface of the trim, wherein the trim is positioned between the second panel and the outer edge of the frame in the second lid configuration.

9. The lid assembly of claim 8, wherein the frame includes a raised inner edge with a platform, wherein at least one of the first panel and the second panel are selectively positioned on the platform.

10. The lid assembly of claim 9, wherein the frame includes support structures extending between the raised outer edge and the raised inner edge.

11. The lid assembly of claim 8, wherein the trim includes tabs to assist in aligning the trim relative to at least one of the frame and the second panel.

12. The lid assembly of claim 8, wherein the snap elements of the trim selectively engage the snap feature apertures of the frame when in the second lid configuration.

13. The lid assembly of claim 8, wherein the openings of the protrusions of the trim are configured to align with the bosses of the frame to receive a fastener in the second lid configuration.

14. The lid assembly of claim 8, wherein the trim is flush with the second panel in the second lid configuration.

15. The lid assembly of claim 8, further comprising:

a pad coupled to the frame and configured to be disposed between the frame and the first panel in the first lid configuration and between the frame and the trim in the second lid configuration.

* * * * *